United States Patent [19]

Alongi et al.

[11] 4,383,662

[45] May 17, 1983

[54] IDEAL TRAJECTORY SHAPING FOR ANTI-ARMOR MISSILES VIA GIMBAL ANGLE CONTROLLER AUTOPILOT

[75] Inventors: Robert E. Alongi; Robert E. Yates; John P. Leonard, all of Huntsville, Ala.

[73] Assignee: The United States of America as represented by the Secretary of the Army, Washington, D.C.

[21] Appl. No.: 885,721

[22] Filed: Mar. 13, 1978

[51] Int. Cl.[3] ..... F41G 7/00

[52] U.S. Cl. ..... 244/3.15; 244/175

[58] Field of Search ..... 73/178 R; 89/41 L, 41 ME; 102/3, 213; 244/3.1, 3.15, 3.16, 3.17, 3.21, 14, 175, 180, 183-187, 189, 190, 196, 197, 3.14; 318/583, 590, 640; 364/427, 429, 456, 462

[56] References Cited

U.S. PATENT DOCUMENTS

| | | | |
|---|---|---|---|
| 3,094,299 | 6/1963 | Bond et al. | 244/197 |
| 3,695,555 | 10/1972 | Chadwick | 244/3.14 |
| 3,735,944 | 5/1973 | Bannett et al. | 244/190 X |
| 3,945,588 | 3/1976 | Maglio, Jr. | 244/3.16 |
| 4,006,871 | 2/1977 | Simpson | 244/186 |
| 4,010,365 | 3/1977 | Meyers et al. | 244/3.16 X |
| 4,108,400 | 8/1978 | Groutage et al. | 244/3.16 X |
| 4,123,019 | 10/1978 | Amberntson | 244/3.16 X |

*Primary Examiner*—Reinhard J. Eisenzopf

*Attorney, Agent, or Firm*—Nathan Edelberg; Robert P. Gibson; Harold W. Hilton

[57] ABSTRACT

Apparatus and method of anti-armor missile trajectory shaping for optimum warhead penetration of armor by a guided missile. The guidance system utilizes a terminal homing guidance unit in conjunction with a programmed control signal through the missile's autopilot to cause the missile to cruise at low altitudes and then dive onto the armor target. The terminal dive angle can be selected dependent upon the target's armor characteristics.

3 Claims, 2 Drawing Figures

IDEAL TRAJECTORY SHAPING FOR ANTI-ARMOR MISSILES VIA GIMBAL ANGLE CONTROLLER AUTOPILOT

DEDICATORY CLAUSE

The invention described herein may be manufactured, used, and licensed by or for the Government for governmental purposes without the payment to us of any royalties thereon.

BACKGROUND OF THE INVENTION

This invention is in the field of terminally guided, anit-armor missiles. Heretofore known terminal guidance missile systems have used proportional navigation with limited trajectory shaping for high accuracy against moving targets. This limited use of trajectory shaping results in either a flat approach trajectory which has reduced warhead penetration or a lofted or ballistic like trajectory. The ballistic like trajectory is often unable to perform well when low cloud cover condition exists. The including of a gimbal angle regulator and boost/cruise trajectory shaping allows low altitude ground or air launch, climb to cruise altitude under a low cloud cover, and then dive onto the target thereby achieving a high probability of penetrating the armor of the target. This invention is not limited to tracker systems that must acquire the target prior to launch such as an infrared imaging seeker, but works equally well with systems that can acquire the target after launch such as laser semiactive systems. The use of conventional known guidance schemes cannot accomplish the high probability of accurate hit concurrent with control of the dive angle for maximum warhead performance. Any ballistic like trajectory for terminally guided missiles must reacquire after descending through the cloud cover adversely affecting the probability of hit and limiting the controllability of the impact attitude.

SUMMARY OF THE INVENTION

The subject invention is a terminal homing guidance method which uses a combination of proportional navigation and seeker gimbal angle control to effect a predetermined missile impact attitude. The missile is launched at low altitude with an initial pointing direction slightly elevated from local horizontal. The missile climbs to a selectable low altitude (for example 600 feet above ground level) levels off and cruises at this altitude. Cruise continues until a point in the trajectory is reached such that diving to impact the target produces the best angle of impact with the target for optimum warhead penetration. At the critical point when the missile changes from a cruise mode to the terminal dive mode, the autopilot produces signals for effecting this transition in the shortest possible time. After the seeker gimbal angle regulation has occured, the terminal homing guidance system reverts to proportional guidance until target impact.

DESCRIPTION OF THE PREFERRED EMBODIMENT

Figure 1:
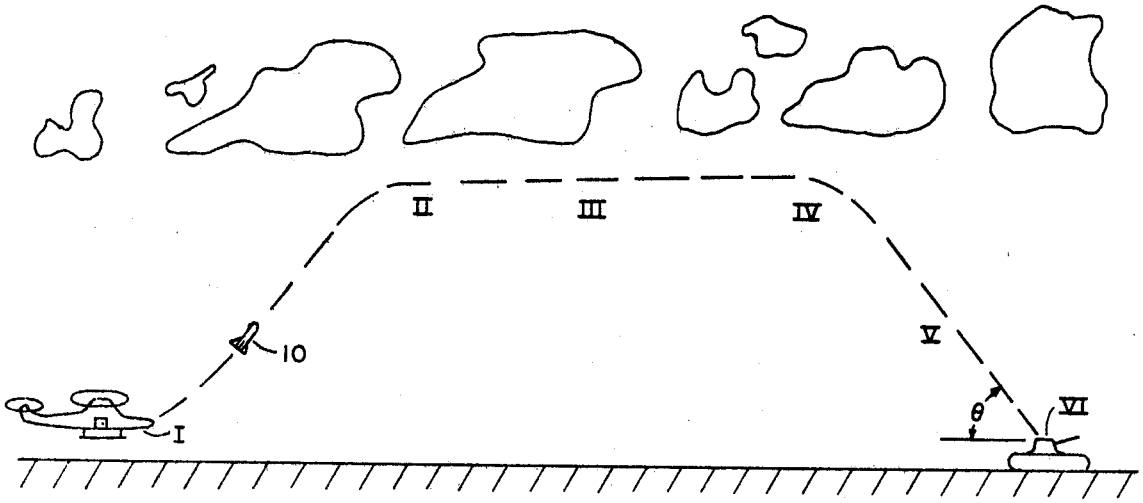
FIG. 1 illustrates the trajectory for a missile using the principles of the present invention.

FIG. 1 illustrates a typical flight trajectory for a missile utilizing the method of the invention. The terminal homing seeker, either a centroid tracker such as a laser semiactive system or a contrast imaging seeker such as an infrared imaging seeker is used to acquire and lock onto the target. The missile is launched with a nearly horizontal initial direction as shown at I. The launch at this point may be either low altitude aircraft launched or launched from a ground launcher. The missile immediately climbs at a constant pitch up rate, then initiates a pitch down rate causing the missile to enter the cruise mode as indicated at II. The missile then flies in the cruise mode during that portion of the flight indicated by III, i.e. that period of flight after pitch over to cruise and prior to the impact attitude transition phase initiated at IV. When the angle between the seeker line of sight, which is tracking the target, and the missile body angle reaches a predetermined value at IV, the missile commences the attitude transition turn to cause the angle between the seeker line of sight and the missile body to approach zero. When this turn is completed, the missile reverts to proportional guidance at V and homes to target impact as indicated at VI.

Figure 2:
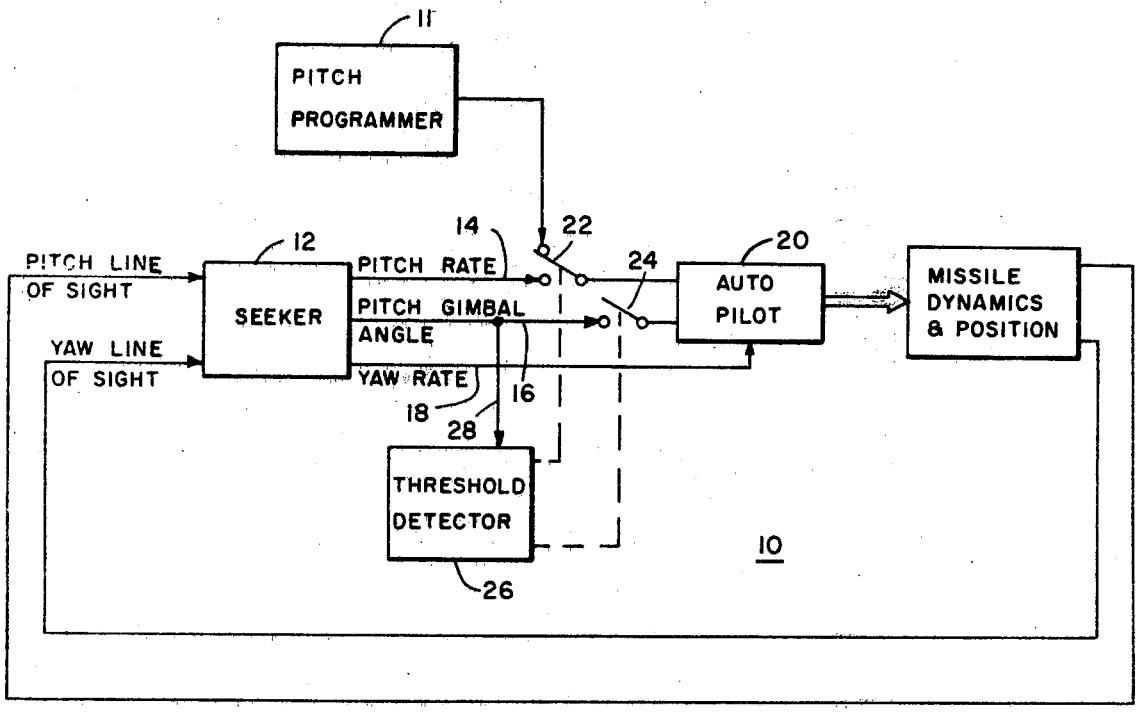
FIG. 2 is a block diagram of the guidance scheme used to achieve the trajectory of FIG. 1.

The guidance scheme for achieving the trajectory of FIG. 1 is illustrated in FIG. 2. A seeker 12 is electrically connected to a pitch rate channel 14, pitch gimbal angle channel 16 and yaw rate channel 18 of an autopilot 20. A pair of switches 22 and 24 are respectively disposed in pitch rate channel 14 and pitch gimbal channel 16. Yaw rate channel 18 is directly connected to the seeker 12. A threshold detector 26 is directly electrically connected to pitch gimbal angle 16 by line 28. Threshold detector 26 is linked to switches 22 and 24.

The terminal homing seeker may be tracking, i.e. locked onto, the selected target prior to launch or it may acquire the target during the cruise phase. In either case, the missile 10 is launched with a nearly horizontal initial direction as shown at I. The launch point may be from either a low altitude aircraft or a ground launcher. Pitch programmer 12 is initiated at launch causing the missile to climb at a fixed pitch rate then initiate a pitch down rate causing the missile to enter the cruise mode as indicated at II. Control of the missile in pitch plane from launch through cruise III to the attitude transition phase IV is by the pitch programmer, therefore, no seeker signals are accepted by the autopilot in the pitch channel until point IV. The missile is guided in the yaw plane by conventional proportional navigation after target acquisition whether that occurs prior to or subsequent to launch. If the missile is launched without target acquisition, the yaw channel is controlled to zero deviation from the launch trajectory until acquisition occurs and then guidance reverts to proportional navigation. During the cruise phase but after target tracking has occured, the guidance system which includes a threshold detector 14 and autopilot 14 monitors the angle between the missile body centerline and the seeker down looking line of sight to the target in the pitch plane. When this angle exceeds a predetermined value (normally 70 to 90% of the desired impact attitude) switch 24 in the autopilot pitch channel 16 is enabled by threshold detector 26 which introduces a rapidly decaying ramp input function into the pitch channel. This gimbal angle regulator causes the missile velocity vector to change from horizontal to a direction coincident to the seeker lookdown line of sight pointing at the target. The proportional navigation system is energized in the pitch channel when the gimbal angle regulator has decayed by approximately 75%. The gimbal angle regulator effects a missile turn in minimal time allowing sufficient time for the proportional navigation scheme to cause an accurate target impact.

We claim:

1. A missile guidance system for maintaining a missile in a predetermined trajectory to impact with a target, said trajectory including an initial substantially horizontal portion, pitch-up, cruise and attitude transition portions, said guidance system including:

(a) programmed guidance means for controlling said missile to said attitude transition portion subsequent to flight in said horizontal, pitch-up, and cruise portions of said trajectory;

(b) a seeker carried by said missile for tracking said target;

(c) means carried on said missile for determining the angle between the line of sight of said seeker and the body of the missile and for transmitting a signal when said angle reaches a predetermined value said means being a threshold detector, first and second switches disposed in the pitch rate and gimbal angle channels of said seeker, said threshold detector disposed for closing said switches; and (d) autopilot means disposed for receiving said signal to pitch said missile downwardly for impact with said target responsive to said angle reaching said predetermined value.

2. A guidance system as set forth in claim 1 wherein said missile is programmed to said attitude transition portion and utilizes proportional navigation thereafter.

3. A guidance system as set forth in claim 2 including a pitch programmer for programming said missile to said attitude transition portion.

* * * * *